United States Patent [19]

Hetman

[11] 4,067,163

[45] Jan. 10, 1978

[54] THERMALLY INSULATED AND CONNECTED WINDOW FRAME MEMBERS AND THE METHOD OF MAKING THE SAME

[76] Inventor: Frank W. Hetman, 124 Paisley Lane, Minneapolis, Minn. 55422

[21] Appl. No.: 776,664

[22] Filed: Mar. 11, 1977

[51] Int. Cl.[2] ..... E04B 1/62

[52] U.S. Cl. ..... 52/403; 49/DIG. 1; 29/155 R

[58] Field of Search ..... 52/403, 729, 309.1, 52/743; 49/504, DIG. 1; 29/155 R

[56] References Cited

U.S. PATENT DOCUMENTS

| | | | |
|---|---|---|---|
| 3,093,217 | 6/1963 | Doede | 52/403 X |
| 3,204,324 | 9/1965 | Nilsen | 49/DIG. 1 |
| 3,332,170 | 7/1967 | Bangs | 52/309.11 X |
| 3,393,487 | 7/1968 | Nolan | 52/403 |
| 3,818,666 | 6/1974 | Winans | 52/403 |
| 3,823,524 | 7/1974 | Weinstein | 52/403 X |
| 3,865,914 | 2/1975 | Nahr | 49/DIG. 1 |
| 3,916,503 | 11/1975 | Chenevert et al. | 49/DIG. 1 |

FOREIGN PATENT DOCUMENTS

| | | | |
|---|---|---|---|
| 768,499 | 2/1957 | United Kingdom | 52/403 |

*Primary Examiner*—J. Karl Bell

*Attorney, Agent, or Firm*—Wicks & Nemer

[57] ABSTRACT

A thermally insulated and connected window frame construction including first and second frame members having interfitting spaced portions with voids therebetween. An initial web portion connects the first and second frame portions. The inner surfaces of the frame members are coated with a bond inhibitor such as talcum powder. A plastic resin is applied into the voids between the interfitting frame portions. The resin is then allowed to "set" and following that the initial web portion is removed with the sole connection of the frame members being the resinous material with the frame members freely slidable upon the bond inhibitor during expansion and construction of the frame members.

The frame construction may be given structural integrity by inserting an elongated strip of material which extends into the voids between the frame members prior to the applying the resin, the strip of material is also coated with a bond inhibitor prior to the application of the resin.

5 Claims, 4 Drawing Figures

FIG. 1
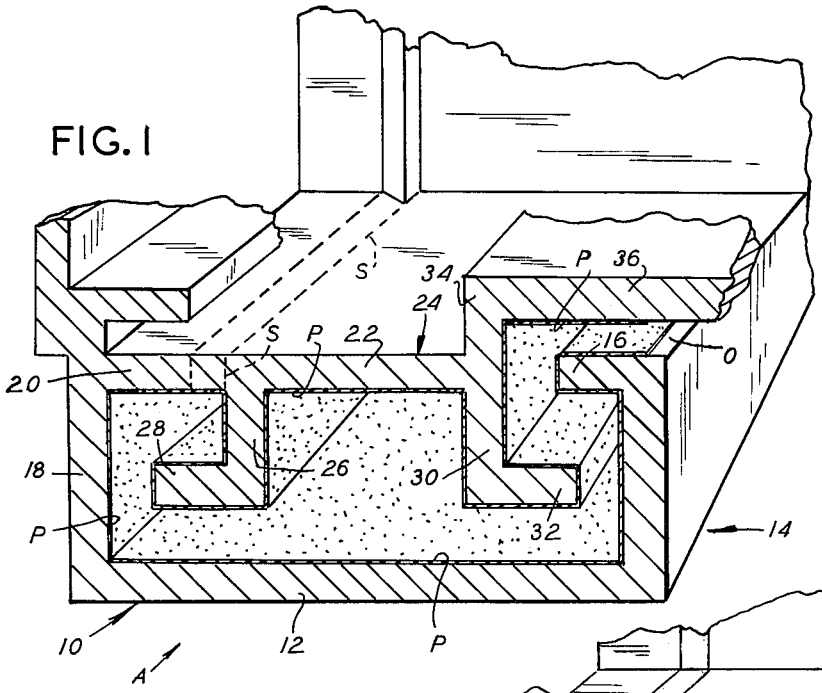
FIG. 2
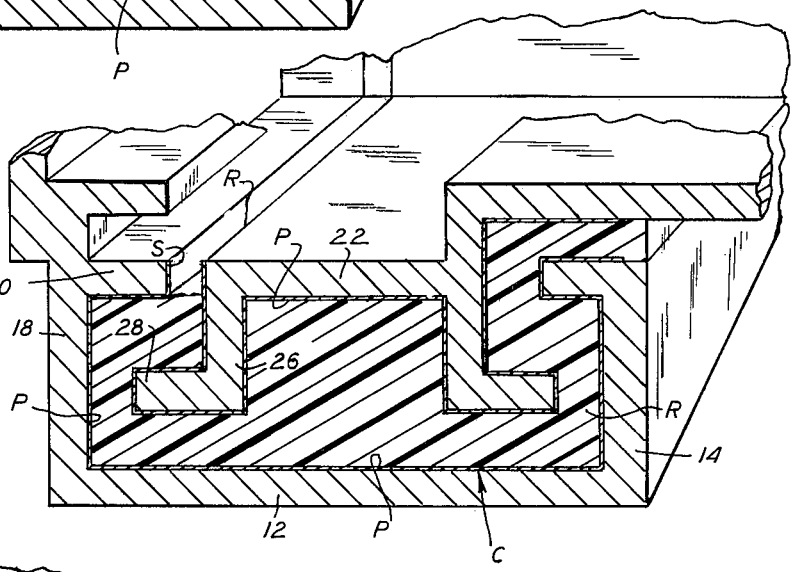
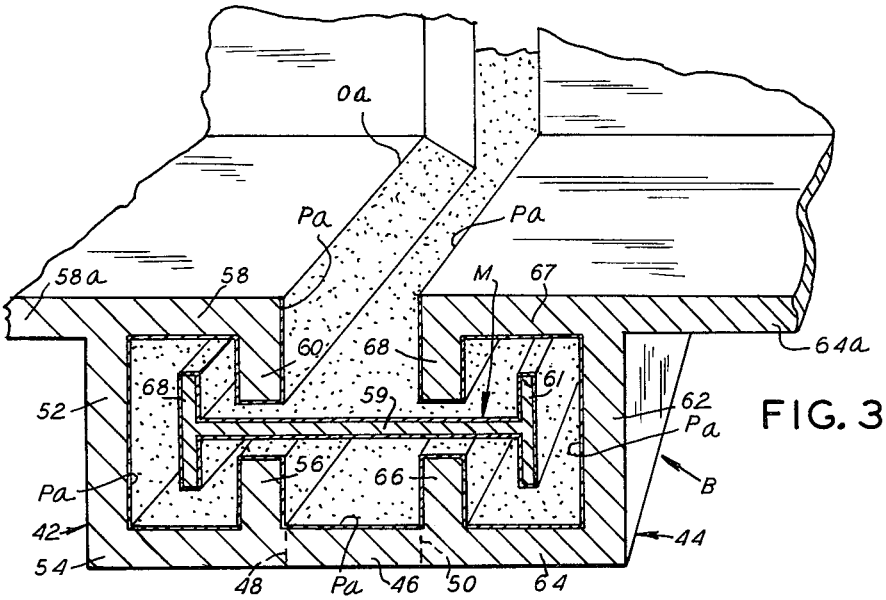
FIG. 3

THERMALLY INSULATED AND CONNECTED WINDOW FRAME MEMBERS AND THE METHOD OF MAKING THE SAME

SUMMARY

The invention relates broadly to an improvement in metal window frames and more particularly to inner and outer metal window frames joined and insulated by a thermal separator connector member generally made of plastic.

In U.S. Pat. No. 3,204,324 an insulating spacer member 12 is formed by first extruding inner and outer metal window frame members connected by a metal web portion. An epoxy resin or the like is then poured into the voids and channels formed between the connected frame members. When the resin "sets" into a ridid formation it forms an insulative connector member. The web connecting portion of the frames is then cut away whereby there is no metal connection between the frame members to conduct heat and cold. The bond between the resin and the metal frame members is so substantial that upon expansion and contraction of the matal frames due to temperature changes the resin is fractured thereby lending to deterioration and ultimate destruction of the connector member.

The present invention overcomes the above problem by first coating the inner surfaces of the metal frame members with a resin-to-metal bond inhibitor or preventor such as talcum powder, a layer of relatively thin plastic or the like. The resin or plastic of low thermal conductivity is then poured into the voids between the frames and when it "sets" it forms the insulative connector member, and there is no bond between the resin connector member and the metal frames whereby the frames may expand and contract upon the resinous connector without affecting the connector.

Additionally, a reinforcing strip member may be positioned in the voids between the frame members prior to the coating of the interior surfaces of the frame members and the depositing therein the resinous material which forms the connector member, whereby structural integrity is given to the frame member connection.

The invention will appear more clearly from the following detailed description when taken in connection with the accompanying drawings, showing by way of examples a preferred embodiments of the inventive ideas wherein like numerals refer to like parts throughout.

In the drawings forming part of this application:

FIG. 1 is a perspective and sectional view through a thermally insulated and connected inner and an outer metal window frame construction illustrating the first step of the invention, portions of the frame members being broken away.

FIG. 2 is a view similar to FIG. 1 but showing the poured-in thermal connector and the web connecting the frame members as cut.

FIG. 3 is a perspective and sectional view through an outer and an inner metal window frame illustrating a further embodiment of the invention.

Figure 4:
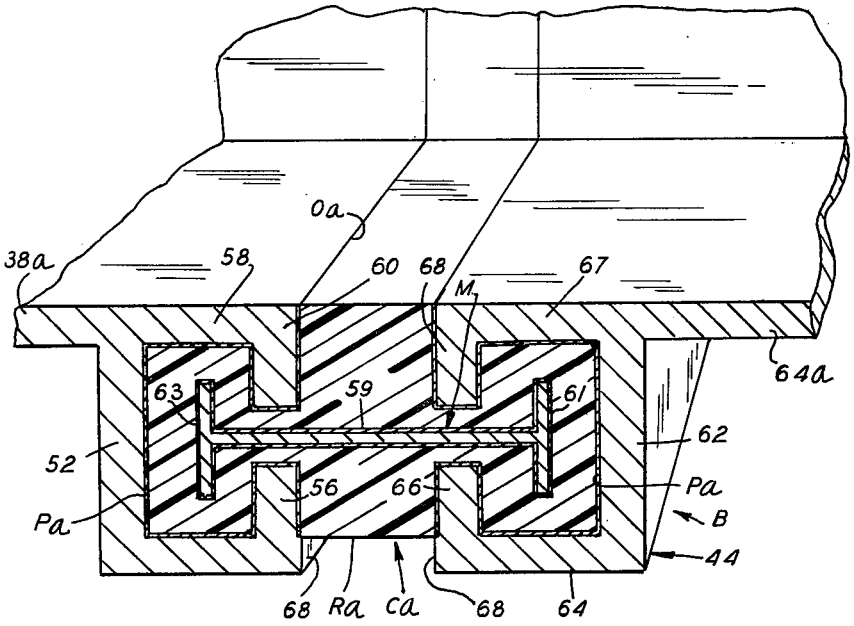
FIG. 4 is a view similar to FIG. 3 but showing a reinforcing member imbedded in the poured-in thermal connector and the web connecting the frame members as cut.

Referring to the drawings in detail, the window frame construction A, in the initial extrusion of which is an inner and outer frame extruded from a single piece of aluminum, includes the inner frame 10 which includes the base portion 12. The outer edge of the base portion 12 terminates in the right angular wall 14 which terminates in the right angular flange portion 16. The other end of the base portion 12 terminates in the right angular inner wall 18 which in turn terminates in the right angular flange portion 20 initially part of the base 22 of the outer frame 24.

Extending from the base 22 and spaced from and parallel to the wall 18 is the flange 26 which terminates in the right angular lip 28 underlying the flange portion 20 and spaced therefrom. The base portion 22 terminates in the flange portion 30 which terminates in the right angular lip 32.

The numeral 34 designates an extension of the flange 30 from the base portion 22, and the extension 34 terminates in the right angular flange portion 36 forming part of the base 22 and overlying the flange portion 16. The flange portion 36 is spaced from the flange 16 thereby forming an opening O between the inner frame 10 and the outer frame 24.

In making up the thermally insulated frame construction A the inner surfaces of the above described member are coated with a bond preventor or inhibitor such as a fine talcum powder P through the opening O between the flange 36 and the flange 16 or the surfaces may be coated with a thin vinyl. Then a liquid resinous adhesive such as an epoxy resin R is deposited into the cavities between the frame members 10 and 24 through the opening O to fill the same and allowed to "set" whereby the cavities are completely filled with the resinous adhesive as illustrated in FIG. 2.

A saw or milled cut S is made in the flange portion 20 where it joins with the base 22 indicated by broken lines in FIG. 1 and the actual cut in FIG. 2 as S thereby producing two separate insulated frame members 10 and 24 with no contact of one frame member with the other the same being separated but interfitting and isulated one from the other by the epoxy filler connector R in the form of the thermal connector C, FIG. 2. With expansion and contraction of outer frame member 24 relative to the inner frame 10 due to temperature changes frame 24 moves relative to the frame 10. If the epoxy alone was used without the powder P and due to its stong adherence of the epoxy to the frame, warpage of and fracture of the epoxy connector and warpage of the frame members would occur. However, with the powder P a sliding movement between the frame parts and the epoxy connector is allowed upon expansion and contraction of the metal frame parts whereby warping of the frame members and fracture of the epoxy connector does not occur. Should there by any failure of the connector R the frames cannot come apart due to the overlap between the flanges 16 and 32 and the flanges 20 and 34.

Relative to FIGS. 3 and 4 there is illustrated thermally insulated and connected frame construction similar to that of FIGS. 1 and 2 but with an inter-locking member that adds structural integrity to the connector connecting the frame members. The window frame construction B includes the inner frame member 42 connected to the outer frame member 44 by the web portion 46 defined between the broken lines 48 and 50, FIG. 3. The outer frame 42 includes the side wall 52 terminating at one edge in the base portion 54 which terminates in the right angular flange 56 spaced from and parallely disposed to the wall portion 52. The other edge of the wall 52 terminates in the right angular top wall portion 58 which in turn terminates in the right angular flange 60 spaced from the sidewall 52 with the edge thereof spaced from the edge of flange 56.

The inner frame 44 includes the side wall 62 terminating at one edge in the base portion 64 which terminates in the right angular flange 66 spaced from and parallely disposed to the wall portion 62. The other edge of the wall 62 terminates in the right angular top wall portion 67 which in turn terminates in the right angular flange 68. Both top wall portion 58 and top wall portion 67 each extend as at 58*A* and 64*A*, respectively, which form parts of conventional inner and outer window frames. Further provided is the structurally reinforcing member M which includes the flat base portion 59 formed at one end with the right angle T flange 61 and at the other end with the right angle T flange 63. The widths of the T portions 61 and 63 are greater than the widths of the slots between flanges 56 and 60 and 66 and 68. As a result the member M adds structural integrity to the connector Ca, FIG. 4, and it prevents separation of the frame members if the connector Ca fails.

In constructing the thermally insulated frame construction B the member M is inserted and held within each of the frames 42 and 44 and it does not contact any of the frame parts. Then the inner surfaces of the above described frame members and reinforcing member M have deposited thereon a bond preventor or inhibitor such as talcum powder Pa through the opening Oa between the edge of the flanges 60 and 68 or the surface may be coated with a thin vinyl. Next a liquid resinous adhesive such as an epoxy resin Ra is deposited into the cavities between the frame members 42 and 44 through opening Oa and allowed to "set" whereby the cavities are completely filled as illustrated in FIG. 4 and the member M held in position. A saw or milled cut 68 is made at the web portion 46 between broken lines 46 and 48 thereby producing two frame members 42 and 44 connected and insulated by the epoxy filler Ra in the form of thermal connector Ca, FIG. 4. With the powder Pa a sliding movement between the frame parts, the reinforcing member M and the connector Ca is allowed whereby fracture of the connector Ca and warpage of the frame parts does not occur.

Having thus described the invention, what is claimed as new and desired to be secured by Letters Patent is:

1. In a window construction the method of thermally insulating and connecting a first frame with a second frame having interfitting portions with voids therebetween consisting in forming an initial web connecting the first frame with the second frame then coating the internal surfaces of the interfitting frames with a bond inhibitor, then applying a resinous self-hardening material into the voids between the interfitting frames, then allowing the resinous material to set, then removing the initial connecting web, with the sole connection of the frame members being the resinous material with the frame members freely slidable upon the bond inhibitor relative to the other during expansion and contraction of the frame members.

2. A thermally insulated and connected window frame construction comprising:

a. a first frame member,
b. a second frame member,
c. said frame members having interfitting spaced portions,
d. a bond inhibitor carried by the inner surfaces of said interfitting frame portions,
e. a plastic connector member formed by applying a plastic resin into the voids between the spaced interfitting portions, said bond inhibitor allowing sliding movement between the connector and the frame members upon expansion and contraction of the frame members.

3. A thermally insulated and connected window frame construction comprising:

a. a first frame member,
b. a second frame member,
c. said frame members having interfitting spaced portions,
d. a reinforcing member extending into said spaced portions and spaced therefrom,
e. a bond inhibitor carried by the inner surfaces of said interfitting frame portions and the surfaces of said reinforcing member,
f. a plastic connector member formed by applying a plastic resin into the voids between the spaced interfitting portions of the frame members and reinforcing member, said bond inhibitor allowing sliding movement between the connector, the frame members and the reinforcing member upon expansion and contraction of the frame members.

4. The device of claim 3 in which a. said reinforcing member is formed of an elongated base portion,
b. said base portion having a flange formed on at least one edge thereof.

5. A thermally insulated and connected window frame construction comprising:

a. a first frame member,
b. a second frame member,
c. said frame members having interfitting spaced portions,
d. a reinforcing member extending into said spaced portions and spaced therefrom,
e. a plastic connector member formed by applying a plastic resin into the voids between the spaced interfitting portions of the frame members and the reinforcing member.

* * * * *